US005562580A

United States Patent [19]

Beasley et al.

[11] Patent Number: 5,562,580

[45] Date of Patent: Oct. 8, 1996

[54] SELF-OPENING POLYETHYLENE BAG STACK AND PROCESS FOR PRODUCING SAME

[75] Inventors: M. Wayne Beasley, Bishopville; Wade D. Fletcher; Harry B. Wilfong, Jr., both of Hartsville, all of S.C.

[73] Assignee: Sonoco Products Company, Hartsville, S.C.

[21] Appl. No.: 193,386

[22] Filed: Feb. 8, 1994

Related U.S. Application Data

[62] Division of Ser. No. 859,037, Mar. 27, 1992.

[51] Int. Cl.[6] ..... B31B 23/86; B31B 27/60

[52] U.S. Cl. ..... 493/194; 493/204

[58] Field of Search ..... 493/193, 194, 493/195, 196, 204

[56] References Cited

U.S. PATENT DOCUMENTS

| | | |
|---|---|---|
| T888,001 | 7/1971 | Drake, Jr. . |
| 3,579,395 | 5/1971 | Rath . |
| 3,959,567 | 5/1976 | Bradley . |
| 4,096,013 | 6/1978 | Lutzmann et al. . |
| 4,264,392 | 4/1981 | Watt . |
| 4,273,549 | 6/1981 | Pezzana et al. . |
| 4,559,250 | 12/1985 | Paige . |
| 4,560,067 | 12/1985 | Reimann . |
| 4,772,348 | 9/1988 | Hirokawa et al. . |
| 4,819,806 | 4/1989 | Pistner . |
| 4,854,999 | 8/1989 | Schirmer . |
| 4,877,473 | 10/1989 | Snowdon et al. . |
| 4,900,388 | 2/1990 | Wyslotsky . |
| 4,989,732 | 2/1991 | Smith . |
| 5,020,750 | 6/1991 | Vrooman et al. . |
| 5,087,234 | 2/1992 | Prader et al. . |
| 5,183,158 | 2/1993 | Boyd et al. . |

FOREIGN PATENT DOCUMENTS

| | | |
|---|---|---|
| 55-6503 | 2/1980 | Japan . |

*Primary Examiner*—Jack W. Lavinder
*Attorney, Agent, or Firm*—Bell, Seltzer, Park & Gibson, P.A.

[57] ABSTRACT

The invention provides self-opening polyethylene film bag stacks which do not require a separate adhesive layer between adjacent bags. The self-opening bag stack according to the invention preferably include a plurality of stacked t-shirt type high density polyethylene film bags releasably adhered together. At least an upper portion of the outer surface of the front and rear walls of each of the bags in the bag stack has been corona treated and at least one localized compressed area extends transversely through the bag stack in the upper portion of the bags such that the stack has a decreased thickness in the localized compressed area and so that adjacent outer wall corona treated surfaces defined by the localized compressed area are releasably adhered together.

10 Claims, 6 Drawing Sheets

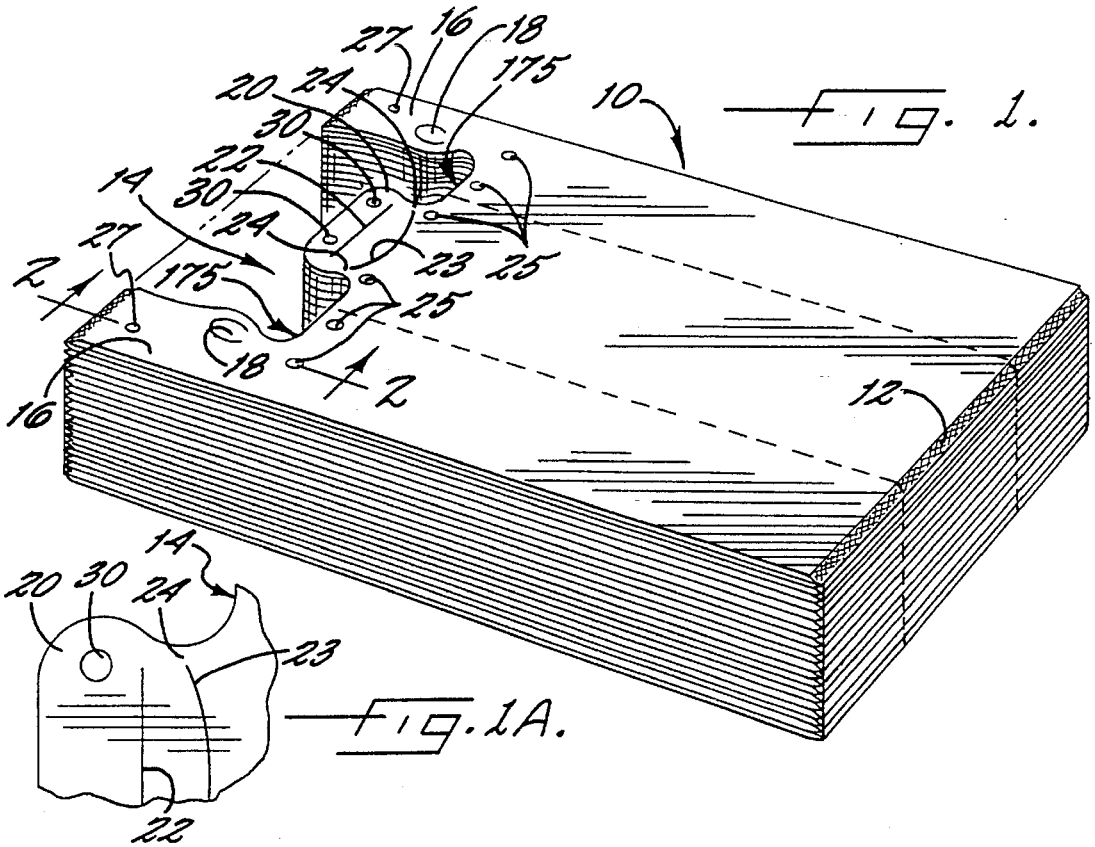
FIG. 1.
FIG. 1A.
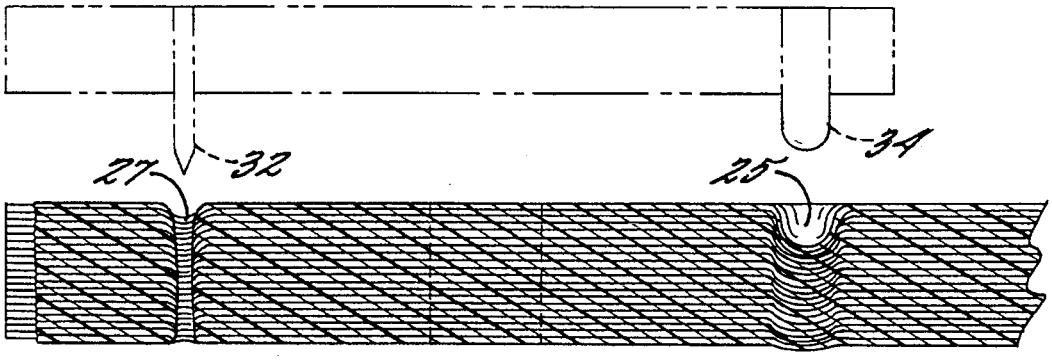
FIG. 2.
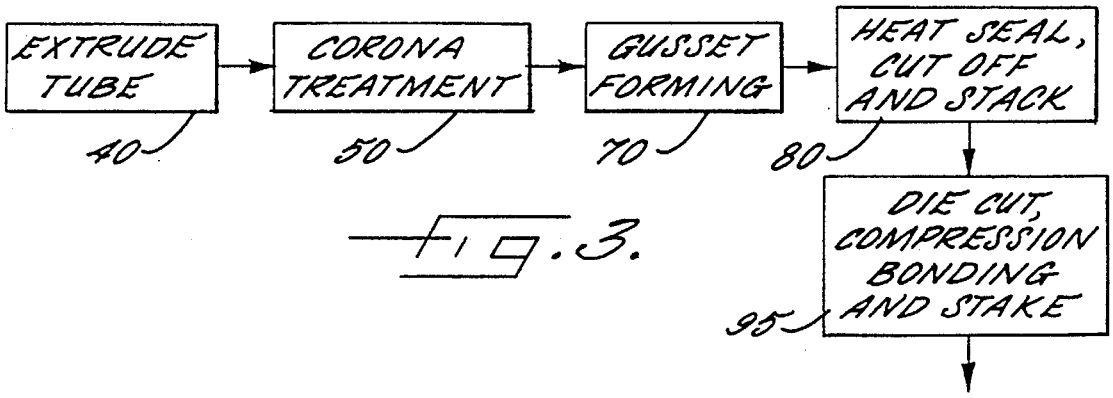
FIG. 3.

42
52
54
56
57
58
59
60
72
74
76
78
82
84
86
88
90
5
6

SELF-OPENING POLYETHYLENE BAG STACK AND PROCESS FOR PRODUCING SAME

This application is a divisional of application Ser. No. 07/859,037, filed Mar. 27, 1992.

FIELD OF THE INVENTION

This invention relates to thermoplastic bags of the type which are used in the grocery and retail industry. More specifically, this invention relates to a self-opening stack polyethylene bags and to the process for their production.

BACKGROUND OF THE INVENTION

During the past decade, plastic bags have replaced paper bags in the United States for the grocery and retail products industries at a rapid pace because of various inherent advantages in plastic bags. For the most part, these plastic bags have been of the T-shirt type which provide laterally spaced handles integrally extending upwardly from opposed sides of an open mouth portion in the top of the bag to provide ease in carrying of the bag by the consumer. Typically, T-shirt bags are used by grocery and retail stores in the form of packs. Each of such packs includes a plurality of bags, typically 50–200. The pack is mounted on a rack for consecutive detachment of the bags from the pack. The rack also holds the bag in an open position for loading by the sales clerk.

A particularly advantageous bag/rack system, the QUIK-MATE® bag/rack system is disclosed in U.S. Pat. No. 4,676,378. This system allows bags to be supported for loading and to be consecutively removed, one at a time, from a bag pack. An improvement of this system is disclosed in U.S. Pat. No. 5,020,750 to Vrooman, et al. which is assigned to the assignee of the present invention. In accordance with the system disclosed therein, each consecutive bag is self-opening. A disengageable adhesive means is provided between consecutive bags so that the rear wall of each bag is connected to the front wall of the bag behind it. As a filled grocery bag is removed from the bag-rag system, the front wall of the next bag is automatically opened. The resistive force provided by the rack arms against the sliding of the bags results in the breaking of the adhesive means connecting consecutive bags so that a filled grocery bag can be removed from the rack without pulling with it, the next consecutive empty bag, thus avoiding a "daisy chain" effect.

Self-opening bag packs which employ a pressure induced adhesive means between consecutive bags have also been commercially used. As commercially marketed by a number of manufacturers, these bags are composed of a low density polyethylene polymer such as low density polyethylene (LDPE) or linear low density polyethylene (LLDPE). A process for manufacturing bags of this type is disclosed in U.S. Pat. No. 5,087,234 to Prader, et al. According to this disclosure, such bags can be made of various polyethylene materials including low, medium, and high density polyethylene, and they are prepared by corona treating a film tube in a layflat condition and thereafter pressure bonding consecutive bags together during the bag mouth cutting process. Specifically, according to the disclosure of the patent, the pressure and cutting action employed to form the bag mouth and handles will cause adjacently facing corona discharge treated cut-edge regions to releasably adhere together.

In general, the phenomenon of corona-induced self-adhesion of polyethylene film is not a new development as far as film processors are concerned. On the contrary, processors continually fought this problem, more commonly known as "blocking" for many years. In fact, most LDPE and LLDPE contain specific amounts of slip and anti-block additives to counteract the "blocking" effect. However, high molecular weight, high density polyethylene (HDPE) which has a substantially greater crystallinity and is a substantially linear polymer does not tend to block, and more often than not does not contain any slip or antiblock additives.

The mechanism of hydrogen bonding in polyethylene film as a result of corona treating is reported by Owens in J. Appl. Polym. Sci. 19, 256–271 (1975). The polyethylene films treated by Owens were LLDPE (the material was reported to have density of 0.926). However, the conditions of heat and pressure which readily caused blocking in corona treated LDPE and LLDPE seem to have little or no effect on HDPE.

Apparently for similar reasons, although the process disclosed in Prader U.S. Pat. No. 5,087,234 can be successfully employed on low density polyethylene materials to form self-opening bag stacks, this process is generally ineffective when used for high molecular weight, high density polyethylene (HDPE) bag stacks. Thus, this process is not successful even when the degree of corona discharge treatment applied to the surfaces of the tubular film is increased in order to induce self-adhesion of the outer surfaces of adjacent bags during the mouth and handle cutting process. Similarly, even when the cutting blade edges are dulled in order to increase the degree of pressure exerted on the bags during the cutting process, self-adhesion of adjacent bags for self opening is not achieved with HDPE.

Accordingly, although easy-open bag stacks of LLDPE and LDPE film bags can be readily provided without the necessity of a separate adhesive layer between the bags, a separate adhesive layer is still required between HDPE bags when these bags are prepared by prior art manufacturing processes. Moreover with low density polyethylene materials, the known processes for forming self-opening bags such as described in U.S. Pat. No. 5,087,234 to Prader do not allow for substantial adjustment of the degree of bonding between adjacent bags or variation of bonding locations.

SUMMARY OF THE INVENTION

This invention provides self-opening plastic bag stacks which do not require a separate adhesive layer between adjacent bags. The self-opening bag stacks according to the invention can be readily manufactured from various polyethylene polymers including HDPE at high speeds and without requiring substantial modification of conventional bag manufacturing equipment. Because a separate adhesive layer is not required between adjacent bags, problems associated with applying an adhesive to each bag are avoided. Moreover, the degree of adhesion between adjacent bags can be varied according to the invention and the adhering areas between adjacent bags can be positioned at varying desirable locations according to different bag constructions so that self-opening bags which are repeatably and readily self-opening can be provided in accordance with the invention.

Self-opening polyethylene bag stacks according to one preferred aspect of the invention include a plurality of stacked polymeric bags, preferably T-shirt type bags, for example, 50–200 bags, releasibly adhered together in substantial registration in a layflat condition. Each of the bags includes front and rear polymeric walls preferably comprising at least about 50 wt. % HDPE, and more preferably at least about 70–90 wt. % HDPE. The front and rear walls are integrally joined at their sides and are secured together at their bottoms and define an open top mouth portion. At least an upper portion of the outer surface of the front and rear walls of each bag has been corona treated to a substantial degree. In the case of HDPE bags the degree of corona treatment is typically somewhat greater than the degree of corona treatment required to provide a water-based ink adherent surface. There is at least one, and advantageously a plurality, of localized compressed areas extending transversely through the bag stack in the upper region of the bag stack, i.e. near the bag mouth portions, such that the stack has a decreased thickness in the localized compressed area or areas and so that adjacent corona-treated outer wall surfaces defined by the compressed area or areas, are releasibly adhered together. Non-corona treated areas of the bag, e.g., inside surfaces of the bags, do not adhere together. Preferably there are a plurality of compressed areas in the bag stack and each of the compressed areas is spaced below the mouth of the bag stack so that the edges of the individual bags are not weakened.

Self-opening stacks of bags according to the invention are made by extruding a polyethylene tube and corona treating outside surfaces of the tube while it is in a collapsed form. The continuous tube is sealed and severed into individual bag length blanks which are then stacked in substantial registration. The stack is subjected to a cutting operation for cutting mouths and integral handles into the stack. Localized pressure is applied to an area or areas of the bag stack using a pressure member or members having a pressure application surface which is substantially free of sharp edges to thereby form localized compression bonds between the corona-treated outer surfaces of adjacent bags and provide one or more compression bonded areas of decreased thickness in the bag stack. Advantageously the tube forming operation is conducted using a polymer which is at least 50 wt. % HDPE.

In preferred embodiments of the invention, the bags include an integral side gusset on each side thereof and there is at least one localized compressed area extending through the gusseted portions of the bag stack. In addition, it is preferred that the localized areas of compression be formed during the bag mouth cutting operation by including pressurizing members in the die which is used to cut the bag mouths. Preferred pressurizing members are cylindrical members having a hemispherically shaped end portion for contacting the surfaces of the bag stacks. Because the bag stack is thicker at the side gusseted areas as compared to the middle, non-gusseted portion of the stack, the pressure members employed to provide localized compressed areas in the gusseted portions of the bag stack are of different lengths than the members employed to provide compressed areas in the central non-gusseted portions of the bag stack. In addition, it is preferred that the bags be of the T-shirt type and that integral handles of the bag stack be maintained in registration by "cold welds" formed by a "cold staking" operation which is also preferably conducted during the mouth cutting process.

Advantageously, the bag stacks of the invention are stacks of the type adapted to be supported by the integrally formed handles and by a center support portion formed in a central portion extending upwardly from the mouth area of each bag. A bag wall portion or portions detachably connect one or both of the bag walls to the central support to provide a predetermined severance strength which is less than the degree of adhesion between adjacent bags provided by the localized compression area or areas in the bag stack. Accordingly, when the bag stack is used in combination with a rack system, preferably of the type disclosed in U.S. Pat. No. 5,020,750 to Vrooman, et al. which is hereby incorporated by reference, the removal of a filled bag from the rack automatically causes the front wall of the next consecutive bag to be detached from the central tab of the bag stack thus resulting in the self-opening of the next consecutive bag.

BRIEF DESCRIPTION OF THE DRAWINGS

In the drawings which form a portion of the original disclosure of the invention:

FIG. 1 is a perspective view of a HDPE self opening bag stack of the invention;

FIG. 1A is an enlarged fragmentary view of the central tab support portion of the bag stack of FIG. 1;

FIG. 2 is a partial cross-section view taken along line 2—2 of FIG. 1 and illustrates localized pressure bonded areas and cold welded areas in the bag stack of FIG. 1 and also illustrates, in phantom, a portion of the die used to form the localized compressed areas and cold welded areas;

FIG. 3 is a flow diagram illustrating the steps employed to produce bag stacks according to the invention;

DETAILED DESCRIPTION OF THE PREFERRED EMBODIMENT OF THE INVENTION

Figures 4, 5, 6:
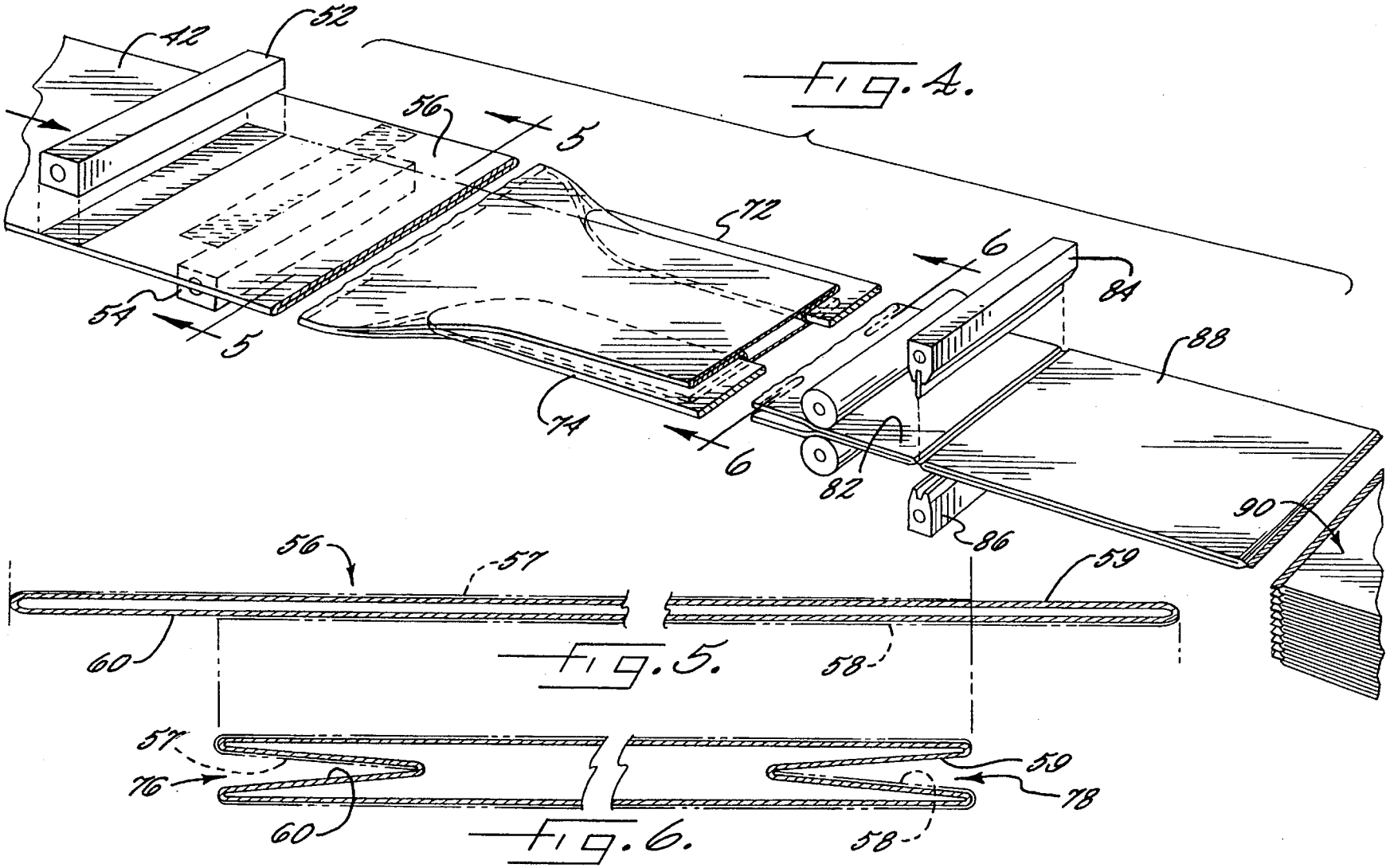
FIG. 4 schematically illustrates preferred corona treating, gusset forming, heat sealing and stacking steps employed in the process of the invention.
FIGS. 5 and 6 are cross-section views taken along lines 5—5 and 6—6 of FIG. 4 and illustrate in phantom the preferred location of corona treated surface areas in the bags of the invention.

In the following detailed description of the invention, various preferred embodiments are described in order to provide a full and complete understanding of the invention and its preferred embodiments. It will be recognized that although specific terms are employed, these are employed in the descriptive and not in the generic sense, and it will be understood that the invention is susceptible to numerous and various alternatives, modifications and equivalents as will be apparent to the skilled artisan.

FIG. 1 illustrates in perspective a perferred self-opening bag stack 10 according to the invention. As illustrated in FIG. 1, the bag stack 10 includes a plurality of T-shirt type stacked bags each including a sealed bottom end 12 and an open top mouth end 14. Laterally spaced, upwardly extending handle portions 16 are integrally formed in the bags. Each handle portion 16 includes an apertured portion 18 for mounting on a rack system as discussed in greater detail later. In addition, a central tab support portion of the stack 20 includes a slit or aperture 22 for mounting the bags stack 10 on a conventional rack system. Another aperture 23 defines residual wall segments 24 (best seen in FIG. 1A) which detachably connect the tab support 20 to the mouthend 14 of the bag walls.

A plurality of localized compressed areas 25 extend transversely through the bag stack 10 so that the bag stack has a lesser thickness in the compressed area as best seen in FIG. 2. An area 27 of cold welding extends transversely through the handle of each bag in the bag stack and helps to maintain the individual bags of the bag stack 10 in registration prior to use. Preferably, there are hot welded areas 30 in the top of the central tab 20 which welds the entire tab portion 20 of the stack into a detachable unit. As generally shown in phantom in FIG. 2, the cold welded area 27 in handle 16 is preferably formed by a pointed, frustroconical cold staking member 32 which pierces and compresses the bag stack, while the localized compressed areas are preferably formed by a cylindrical member 34 having a pressure application surface 36 substantially free of any sharp edges. This prevents bags in the bag stack 10, and particularly the bags on top of the bag stack 10 from being torn during the localized compression operation as explained in greater detail later.

The various steps employed to form the preferred self-opening bag stack of the invention are set forth in the block flow diagram of FIG. 3 and are schematically illustrated in FIG. 4. In step 40, a continuous polyethylene tube 42 is extruded, preferably from a high density polyethylene polymer, in a manner which is well known in the art. Typically, the film has a thickness of from about 0.4 to about 0.8 mils (0.0004 to about 0.0008 inches), preferably 0.5 to 0.6 mil. High density polyethylene polymers are known in the art and typically have a density of greater than about 0.945, preferably greater than about 0.948 g/cm$^3$. High density polyethylene polymers have a highly linear structure and normally have a crystallinity of greater than about 85%. In general, HDPE is prepared by the polymerization of ethylene using Ziegler catalysts to thereby provide the highly linear, highly crystalline polymer. The HDPE employed to form the extruded tubes in the present invention preferably has a melt index ($MI_2$) of at least about 0.04, preferably from about 0.05 up to about 0.07. Particularly preferred HDPE has a density of 0.948–0.950 g/cm$^3$, a melt index ($MI_2$) of 0.057 and is commercially available from Occidental Chemical Corp., Bay City, Tex. as "L5005" blown film grade HMW-HDPE.

The high molecular weight HDPE is advantageously present in an amount greater than about 50 wt. % of the total polymer weight, preferably greater than about 75 wt. % of the total polymer weight, most preferably about 80–90 wt. % or higher based on the total polymer weight. A low density polyethylene material, such as LLDPE is advantageously blended with the HDPE in an amount of from about 4 to about 10 wt. % or higher and the blend can also include regrind materials, i.e. recovered film waste, in an amount of up to about 65 wt. %. Various coloring agents and/or pigments such as titanium dioxide are advantageously included in the film in an amount of between about 3 and about 5 wt. %.

As known in the art, the tubular film is extruded in an inflated condition and is then collapsed and wound up in a flattened condition. Following flattening of the film, but prior to wind up, it is subjected to a corona treatment 50 on both sides of the flattened film employing conventional corona electrodes 52, 54. Corona treatment processes are well known in the art and are conventionally employed with all of the various grades of polyethylene films in order to provide an ink receptive surface.

In general, corona treatment is accomplished by employing an electrode, such as electrode 52 or 54, suspended adjacent the film and operating against a dielectric roll, for example, a silicone covered roll which supports the film. Corona treating devices for flattened tubular film are commercially available from numerous sources including Pillar Technologies Inc., Hartland, Wis., which supplies a split box corona treating station suitable for use in the process of this invention.

The degree of corona treatment applied to a blown film is dependent on various factors including the surface area of the electrode, the wattage supplied to the electrode and the speed of the film moving beneath the electrode. In the case of high density polyethylene these conditions are adjusted to provide a corona treatment sufficient to result in a surface tension level on the treated film surface of at least about 40 dynes/cm, preferably about 44–46 dynes/cm or more. As indicated previously, a corona treatment above this level is typically greater than the degree of corona treatment required to result in a water-based ink adherent surface on the HDPE film 42. It has been found that corona treatment at a level sufficient to provide a surface tension level of greater than about 40–42 dynes/cm is sufficient to provide a bondable surface while higher treatment levels increase bond strength and improve results even further. Preferably the corona treatment provides a surface tension level of about 44–46 dyne/cm in the case of HDPE film As illustrated in FIG. 4, the electrodes 52 and 54 are staggered laterally with respect to the top and bottom surfaces of the flattened film 42. As best seen in FIG. 5, this results in a treated film 56 which includes a corona treated surface 57 on the top, as generally illustrated by phantom lines in FIG. 4 which extends only partially laterally across the film surface. This top corona treated surface 57 is staggered with respect to the corona treated surface 58 on the bottom of the flattened film tube. As a result of the positioning of the electrodes 52 and 54, there is a non-corona treated portion at an edge 59 on the top surface of the flattened tube which is on the opposite edge in relation to a non-corona treated surface on the bottom of the flattened tube 60. As explained below, these non-corona treated top and bottom surfaces 59 and 60, are advantageously of a width the same as or greater than the width of a gusset which is formed in the next step of the process, step 70. Prior to the gusset forming step, the tube is advantageously subjected to a printing step (not shown).

The gusset forming step 70, as illustrated in FIG. 4 involves the use of conventional gusset forming members 72 and 74 which tuck in the sides of the tube 56 to thereby form integral gussets longitudinally along the length of the film. As known to the skilled artisan, the gusset forming step is conducted while the tube is maintained in an inflated state.

As best seen in FIG. 6, one of the opposed outer surfaces within each of the left and right gussets, 76 and 78, respectively, includes a non-corona treated surface. Thus, the left side gusset 76 includes one outer surface, 57 which is corona treated and an opposed surface 60 which is not corona treated. Similarly, the right side gusset includes one outer surface, 59 which is not corona treated and an opposed outer surface, 58 which includes a corona treatment. This allows for the presence of printing on one outer surface within the gusset, i.e. on corona treated portions 57 or 58. At the same time, the localized pressure treatment for releasable adhesion of adjacent bag surfaces, does not result in bonding of the opposed outer surfaces, 57 and 60, or 59 and 58, within the gusset since only one of the adjacent surfaces is corona treated in each case.

Following the gusset forming operation 70, the gusseted film tube is passed to a cutting and heat sealing operation 80 as illustrated in FIG. 4. The gusseted film tube, 82, is passed to a pair of cutting and heat sealing members, 84 and 86 which cut and heat seal the continuous flattened tube 82 into individual bag length blanks 88 which are then stacked in registration in stacks 90. Preferably two hot welding members (not shown) are employed during the stacking operation to form a weld transversely through the stack to thereby heat bond the blanks together in an area that will later be cut in register with the central tab area 20 to thereby form hot welded areas 30 in bag stack 10 (FIG. 1). Typically, a stack will include from for example, 25 to about 200 bag blanks, preferably 40–150, most preferably 50–100 bag blanks, depending on the thickness of the individual plies of the bags.

Figure 7:
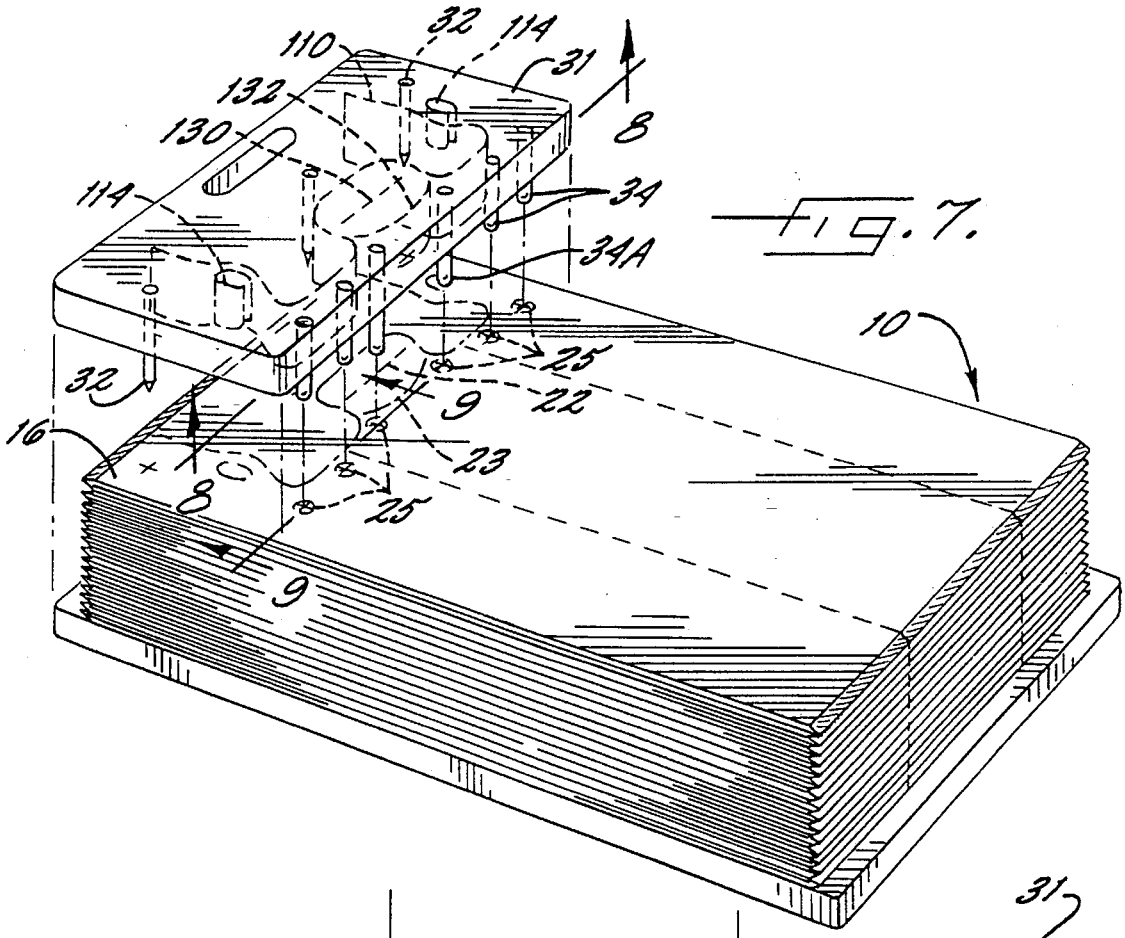
FIG. 7 illustrates a preferred die which can be used in accordance with the invention to cut mouth portions in the bag blank stack while concurrently forming localized compressed areas in bag stacks of the invention.
Figure 8:
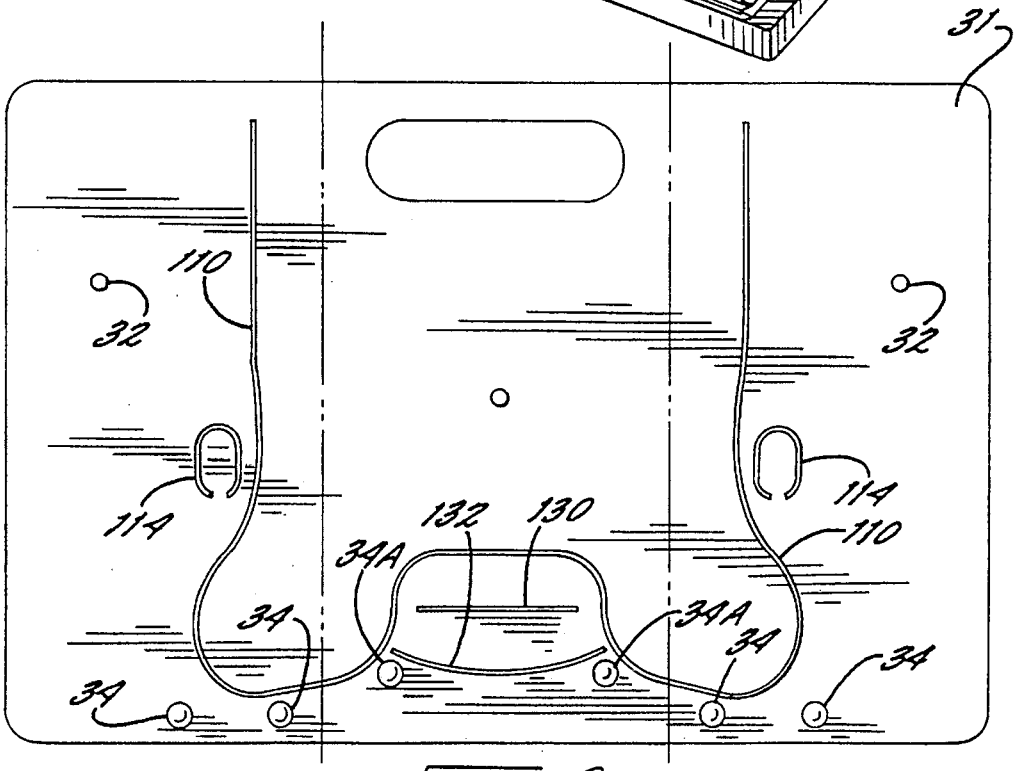
FIG. 8 is a bottom plan view taken along line 8—8 of FIG. 7 and illustrates the die shown in FIG. 7.
Figure 9:
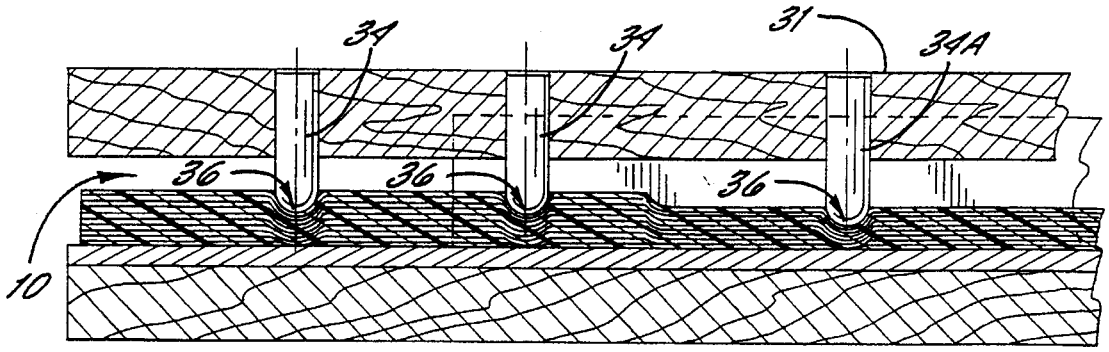
FIG. 9 is a cross-sectional view taken along line 9—9 of FIG. 7 to illustrate application of pressure forming members to different portions of the bag stacks.

The die cutting, compression bonding and cold staking operation 95 is best seen in FIGS. 7, 8 and 9. The die cutting member 31 includes a first continuous blade 110 which cuts the top of the bags and forms both the mouth and the integral, laterally spaced, upwardly extending side handles 16. There are two cold staking pins 32 for piercing the stack and for forming a transverse cold weld 27 through the bag stack (best seen in FIG. 2). As indicated earlier the cold weld 27 helps to maintain the bags in registration with one another prior to use. Six compressing members 34 and 34A in the form of axially extending rods of different lengths form localized compressed areas 25 which extend through the bag stack 10. Blades 114 are disposed laterally on the die 31 for cutting apertures 18 in each of the handles 16 of the bag stack. Curved apertures as formed by blades 114 are also believed to assist in maintaining the individual bags in registration with each other.

The formation of the localized compressed areas is best illustrated in FIG. 9. As shown therein, the shorter cylindrical localized compressing members 34 are positioned to axially compress a portion of the bag stack 10 which is of greater thickness due to the presence of integral side gussets 76 (FIG. 10) in the bag stack. The longer compression members 34A are positioned to axially form compression seals in the central section of the bag stack 10 which is thinner due to the absence of the side gussets 76.

As seen in FIG. 9, each of the compressing members 34 and 34A has a hemispherically shaped end 36 which is preferably polished and is substantially free from sharp edges. Thus, the localized compression bonded areas are formed without tearing or cutting of the bag surface as in the prior art. In the case of HDPE bags the length of the pins 34 and 34A are preferably adjusted to compress the film layers in the stack to a thickness about 30% to about 50% less than, preferably about 35% to about 45% less than the thickness of the stack prior to compression depending on the thickness and composition of the piles. The cutting die with pressure pins was found to use about 5000–6000 lbs force, to cut and compress a stack of 65–70 HDPE bags in a preferred amount. This amount of compression is sufficient to releasably bond the individual layers of film together without tearing and to place the front and back layers of film of consecutive bags in intimate contact allowing the formation of the bonds.

Insufficient compression of the film plies does not result in the formation of a releasable adhering bond between adjacent surfaces. Too much compression can have an adverse effect as well, by bonding the inside surfaces of the film together as well as the outside surfaces, and/or by puncturing top plies. It is to be noted that adhesion between adjacent corona treated pressure bonded areas increases over a period of several days up to about two weeks. Some bonding was found to occur immediately with full bond strength being achieved within 7 to 14 days.

Figure 10:
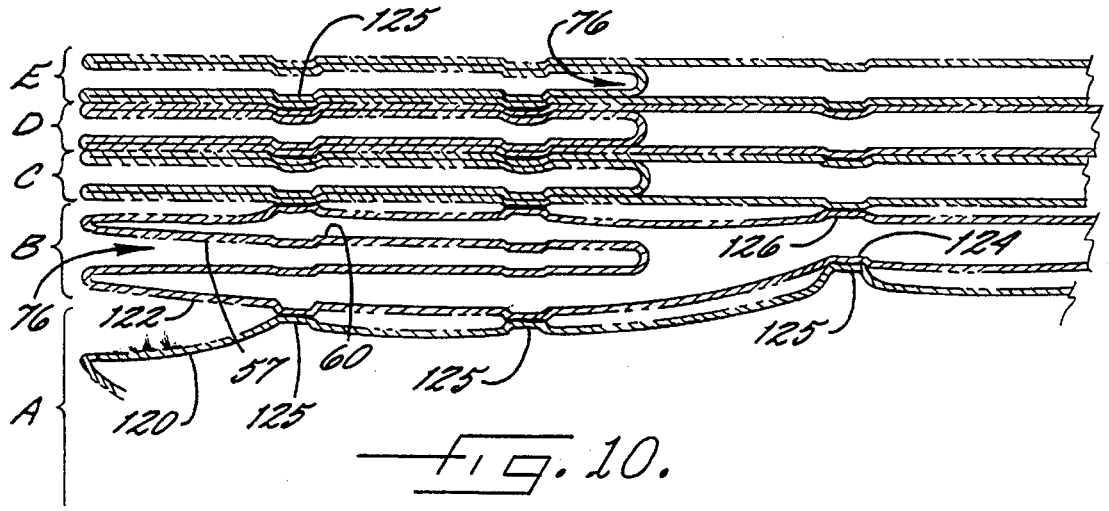
FIG. 10 is an exploded cross-sectional view of a portion of the bag stack shown in FIG. 9 and illustrates the releasable bonding in localized compressed corona treated areas.

FIG. 10 illustrates in exaggerated detail the effect of the compression bonding operation of FIG. 9. As shown in FIG. 10, several bags, labeled "A"–"E" are releasably bonded together. The back wall 120 of bag A is releasably bonded to the front wall 122 of bag B via individual releasable pressure bonds 125. With reference to the inside surfaces 124 and 126 of bag B, it will be seen that there is no bonding between these adjacent inside surfaces at the localized compression areas due to the lack of corona treatment on such inside surfaces. In addition, it will be seen that the opposed outer surfaces 57 and 60 within the gusset 76 are not bonded to each other at the localized compressed area 125 due to the positioning of the corona treatment as described earlier in connection with FIGS. 5 and 6.

Returning to FIGS. 7 and 8, it will be seen that there are linear cutting members 130 and 132 for the central tab area 20 which form laterally oriented slots or apertures 22 and 23 in the central tab. The slot formed by cutting member 130 in the central tab 20 of the bag stack can be used for mounting the tab on a support member of a rack system as discussed in connection with FIGS. 11*a–e*.

The cutting member 132 is used to provide "residual" wall portions 24 (best seen in FIG. 1A) which connect the central tab 20 to the front and back body walls of the bag. As seen in FIG. 1, each of the residual wall areas 24 is defined by the remaining wall portion positioned between each end of the aperture 23 and the mouth end edge of the bag. The size of the residual wall portions is a significant variable for ensuring consistent performance of the bag pack shown in FIG. 1 when mounted on a rack system. The strength of the residual wall portions must be balanced to the bond strength between adjacent bags in the stack to ensure that the releasable bonds between the bags will cause the residual 24 of the adjacent bag in stack to break prior to breaking of the bonds 125 as discussed below in connection with FIGS. 11A–E. On a film gauge of 0.5 to 0.6 mil, a residual width of 0.075 to 0.080 inches was found to give good results when six compression bonded areas arranged substantially as shown in FIG. 1 and each having a diameter of about 0.25 inches were employed. It will be apparent that the size and/or arrangement of the residual wall portions connecting the central tab to the main body of the bag wall can be varied depending on the number, size and arrangement of localized compression bonded areas and on the thickness and strength of the film making up the bag walls.

Figure 11A:
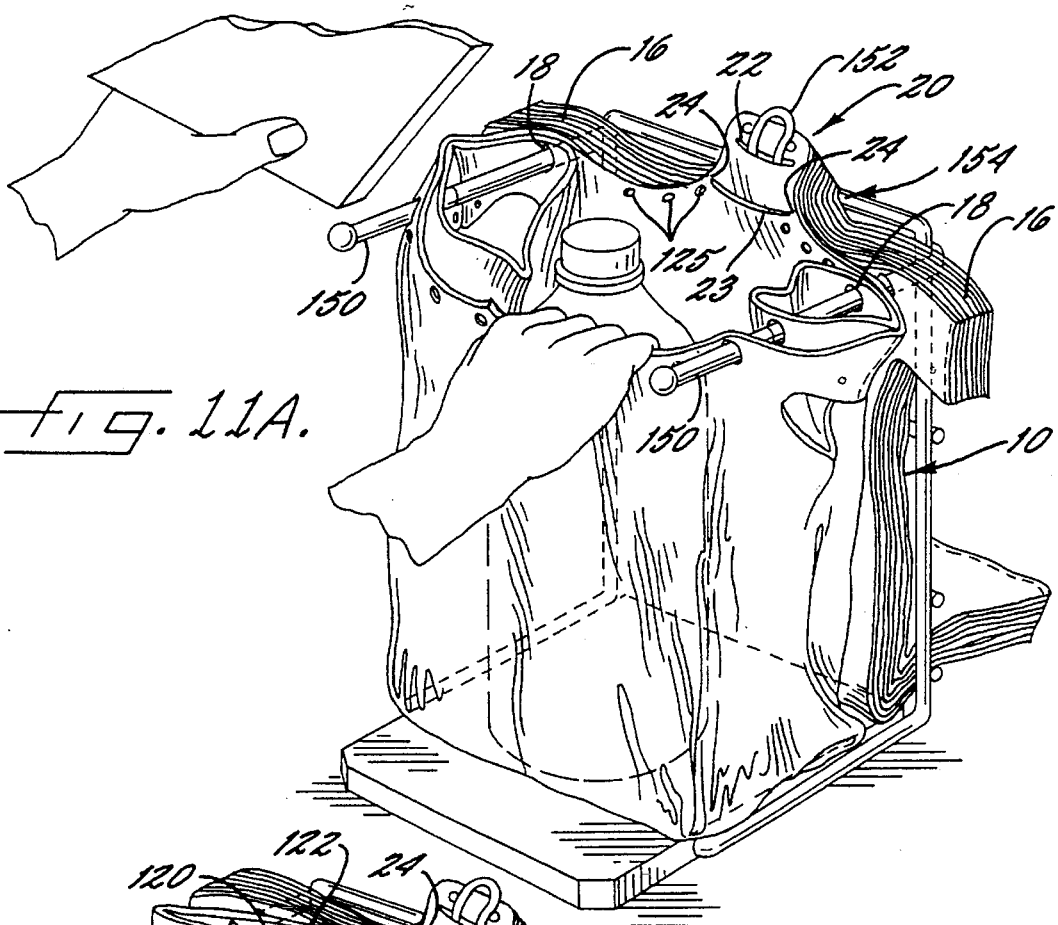
FIGS. 11A–11E are perspective views illustrating consecutive operations carried out when self-opening bag stacks of the invention are used in conjunction with a preferred rack system.

FIGS. 11A–E illustrate use of the bag stack of the invention in conjunction with a rack system, preferably of the type disclosed in U.S. Pat. No. 4,676,378 to Baxley, et al., which is hereby incorporated by reference and/or U.S. Pat. No. 5,020,750 to Vrooman, et al. With reference to FIG. 11A, a stack 10 of self-opening bags according to the invention is shown mounted on arms 150 and center tab support member 152 of a rack system 154. The center support member is passed through a slot 22 in the center tab portion 20 of the bag stack. Similarly, the rack arms 150 pass through apertures 18 formed in the handles 16 of the bag stack as discussed previously.

Figure 11B:
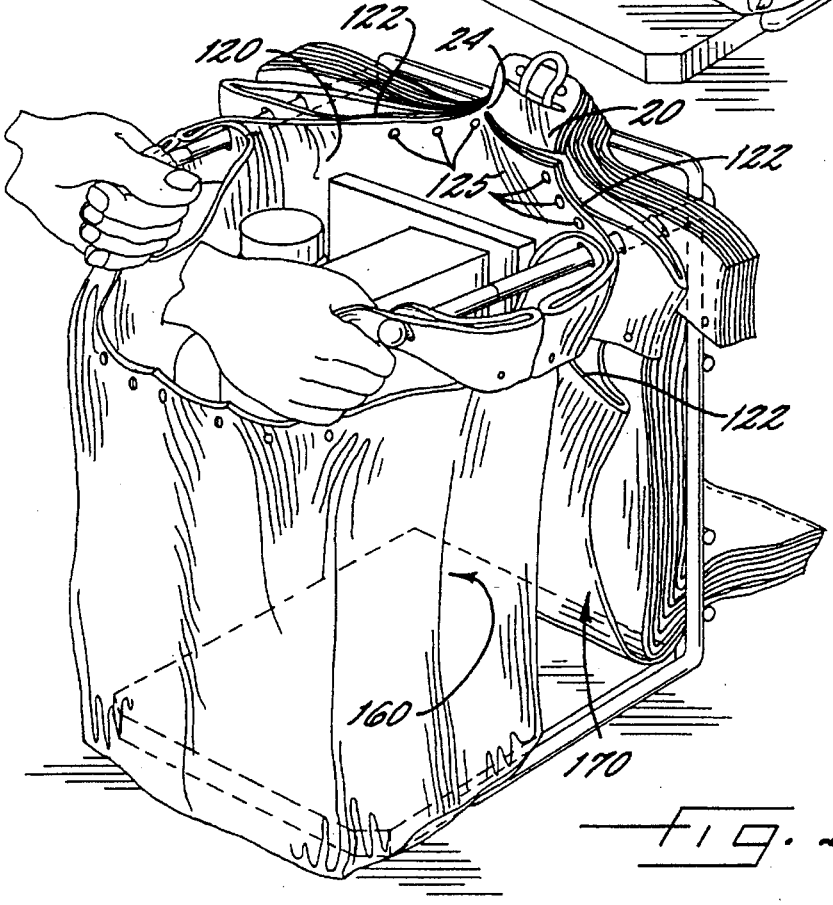

In FIG. 11A, a first bag 160 is being filled with grocery items. When the filling operation is complete, the filled bag 160 is removed from the rack system as generally indicated in FIG. 11B. As shown in FIG. 11B, as the filled bag 160 is removed from the system, the localized adhesion bonds 125 between the back wall 120 of bag 160 and the front wall 122 of the next bag 170 pull open the front wall 122 of the next adjacent bag 170. This results in the breaking of one of the residual wall portions 24 connecting both the back wall 120 of bag 160 and the front wall of the next adjacent bag 170 to the central tab 20. This self-opening process for the next bag 170 continues as shown in FIG. 11*c* as the filled bag 160 continues to be removed from the rack system.

Figures 11C, 11D, 11E:
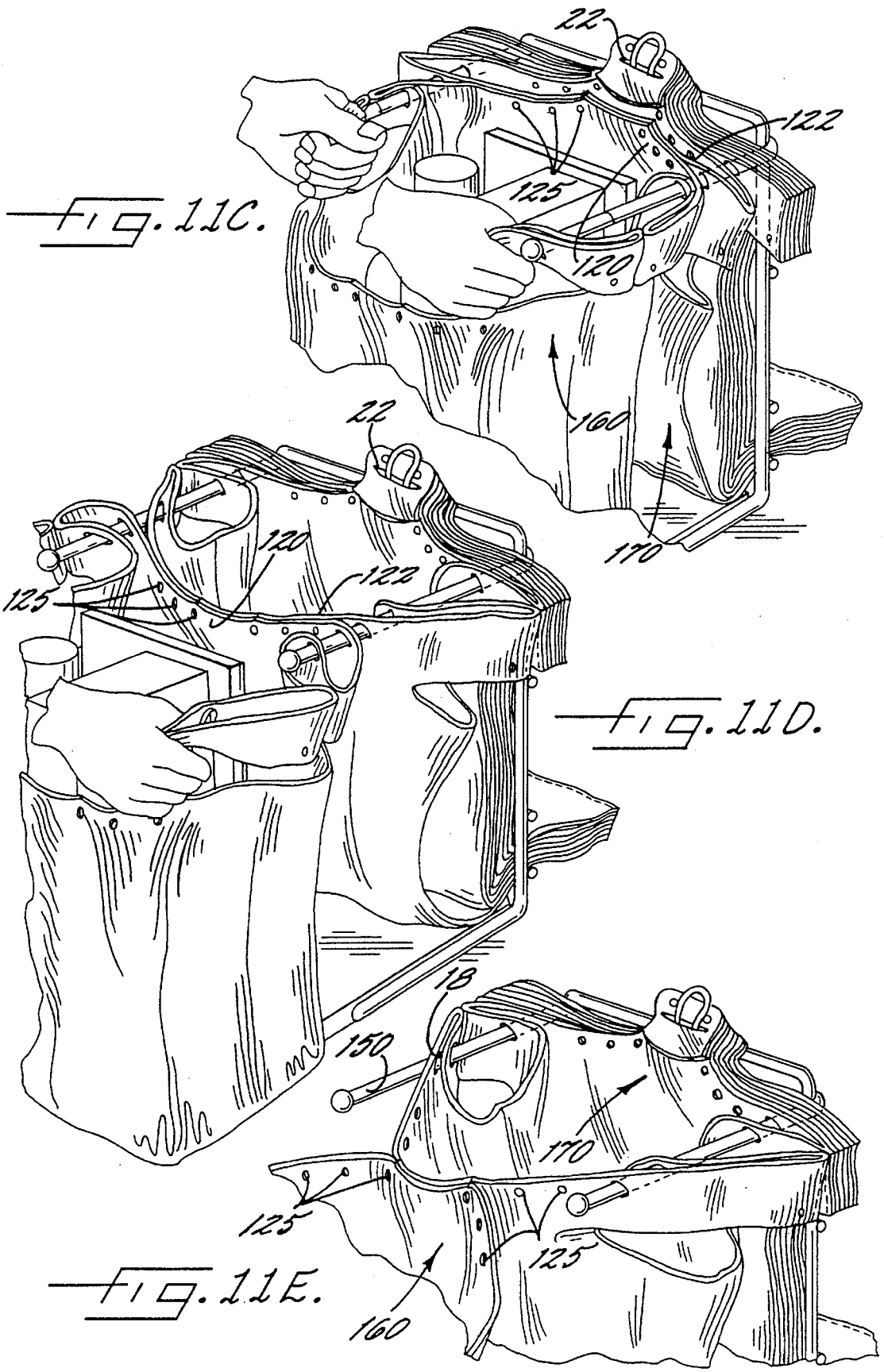

As shown in FIG. 11C, the second residual film layers 24 are next broken. Then, as the front bag 160 is continually moved forward as shown in FIG. 11D, the rear wall 120 of the front bag 160 continually pulls the front wall 122 of the next consecutive bag 170 open. Finally, as shown in FIG. 11E, the localized compression bond areas between adjacent bags are broken due to the resistive force against sliding provided between the surface of support arms 150 of the rack system and the surfaces in the apertures 18 of the bags. As discussed in greater detail in U.S. Pat. No. 5,020,750, the adhesive bonding force between the adjacent bags is less than the force of sliding resistance between the aperture 18 in the bag arms and rack arm surface 150 so that as the filled bag 160 is removed from the rack, all of the remaining compression bonds 125 are broken, leaving the next consecutive bag 170 in a self-opened state as generally shown in FIG. 11E.

The size and location of the localized releasable compression bonded areas 125 in bag stacks of the invention can be varied to achieve various preferred effects. In one preferred embodiment, as generally illustrated in FIGS. 11A–11E, the localized compression bonded areas 125 are arranged so that the individual compression bonds 125 are arranged substantially linearly along a stress area formed between the handle carrying loops and the residual tab areas 24. This substantially linear arrangement is best seen in FIGS. 11B and 11C. This configuration, once the bag stack is mounted on the dispensing rack, places each of the localized bond areas 125, under substantial shear stress, which in turn, allows for utilization of the maximum strength of each of the releasably bonded areas to provide for the breaking of the residual film or web 24. However, other configurations and arrangements of localized compression bonded areas can be employed in the invention in order to achieve increased, and/or decreased bonding between adjacent bag surfaces, as desired.

It is believed that the stretching of the plastic film caused by the compression bonding operation employed in this invention can result in some weakening of the bag walls. It is therefore desirable to avoid placing localized compressed areas directly on the cut edges of the mouths of the bags. It is also desirable to avoid placement of any localized compression bonded areas on the bag wall surface below or directly adjacent the curved area of the bag mouth which joins the bag body to the integral handle as generally indicated at areas 175 in FIG. 1. Because the bags are typically biaxially oriented during the film extrusion process, any tear initiation areas in the high stress regions of the bag can result in a tearing of the entire bag wall. Thus, localized pressure bonded areas are best avoided at or near the areas generally identified 175 in FIG. 1.

As indicated previously, the bag stacks and process of the invention are also applicable to bag stacks made from low density polyethylene materials such as low density polyethylene and linear low density polyethylene. Because low density polyethylene materials more readily form bonds between corona activated surfaces, the force required in order to achieve releasable bonds between adjacent corona treated surfaces in the compression bonded areas, will normally be less than the force used to form compression bonds with HDPE. In addition, the degree of corona treatment applied to the surfaces of the low density polyethylene materials can be decreased, if desired. The use of one or more compression bonded areas per this invention allows the degree of adhesion between adjacent low density polyethylene bags to be controlled in a highly precise manner as compared to prior art processes where the adhesion between adjacent bags is formed during the mouth cutting operation and cannot be positioned differently or over a larger or smaller bonding area.

The invention has been illustrated in connection with T-shirt type bags. However, the invention is also advantageously applied to polymer film bags in connection with bags having numerous different constructions including plastic bag stacks which are dispensed from so-called stub shaft supports as generally shown in U.S. Pat. No. 4,995,860 to Wilfong, Jr. which is hereby incorporated by reference. In addition, the present invention is useful in connection with so-called "front side free bags" which are also know in the art and are discussed in greater detail in the previously mentioned U.S. Pat. No. 4,995,860 to Wilfong. When used with the front side free bags, one or more localized pressure bonded areas are formed on corona treated surfaces at or adjacent mouth regions of the bags. The present invention thereby provides for the front side or front wall of the bag to be self-opening as will be apparent to the skilled artisan. When used with such front side free bags, the localized pressure bonds no longer have to break a residual wall portion and need only to pull the front side panel forward; thus, the degree of bonding between adjacent bag walls can be varied to a substantial extent from a high to a low degree of bonding. Thus, it will be apparent that bag stacks of the invention are useful in various bag constructions and in connection with bag-rack dispensing systems of various and numerous constructions and designs.

The invention has been described in considerable detail with reference to its preferred embodiments. However, it will be apparent that variations and modifications can be made within the spirit and scope of the invention as described in the foregoing detailed specification and defined in the appended claims.

That which is claimed is:

1. A process for the manufacture of a self-opening polyethylene film bag stack comprising:

extruding polyethylene polymer comprising high density polyethylene in an amount of at least about 50 wt. % based on the weight of said polymer into a tube and collapsing said tube into a flattened condition;

corona treating front and back outside surfaces of said tube;

severing and sealing said tube into individual bag length blanks having sealed ends;

forming a stack of between about 25 to about 200 of said blanks in substantial registration with each other;

cutting mouth openings into at least one end of said stack, said mouth openings defining an upper end of said bag stack; and applying a predetermined localized pressure to said stack with at least two pressurizing members having pressure application surfaces free of sharp edges to form compressed areas of decreased thickness in an upper region of said stack such that adjacent outer wall corona treated surfaces defined by said compressed area are releasably adhered together and adjacent inside wall surfaces defined by said compressed areas are not adhered together.

2. The process of claim 1 wherein said polyethylene polymer comprises high density polyethylene in an amount of at least about 75 wt. % based on the weight of said polyethylene polymer.

3. The process of claim 1 additionally comprising the step between said corona treating step and said severing step, of forming longitudinally extending side gussets in said tube.

4. The process of claim 1 wherein said step of applying localized pressure to said stack is conducted concurrently with said step of cutting said mouth openings in said stack.

5. The process of claim 1 wherein said step of applying localized pressure to said stack is conducted separately from said step of cutting said mouth openings in said stack.

6. The process of claim 1 wherein said step of applying localized pressure to said stack comprises contacting said stack with at least two cylindrical shaped pressurizing members having smooth radial shaped pressurizing surfaces.

7. The process of claim 1 wherein said step of applying localized pressure to said stack comprises contacting said stack with at least two cylindrical shaped pressurizing members having hemispherically shaped pressurizing surfaces.

8. The process of claim 1 wherein said pressurizing members are of a length adapted to compress said stack in an amount of at least about 30%.

9. The process of claim 8 wherein said pressurizing members are of a length adapted to compress said stack in an amount of between about 30% and about 50%.

10. The process of claim 1 wherein said corona treating step is conducted to provide a surface tension on said outside surfaces of said flattened tube in an amount greater than about 40 dynes/cm.

* * * * *